United States Patent [19]

Raighn et al.

[11] 3,931,940

[45] Jan. 13, 1976

[54] CARPET FEEDING, MEASURING AND ROLLING APPARATUS

[75] Inventors: Edwin H. Raighn, Los Alamitos; Robert B. Eglinton, South Pasadena; Lorne L. Frazier, Torrance; Robert R. Naylor, Granada Hills; William R. Morris, Newport Beach, all of Calif.

[73] Assignee: Chromalloy American Corporation, New York, N.Y.

[22] Filed: May 10, 1974

[21] Appl. No.: 468,660

[52] U.S. Cl. ..... 242/56 R; 242/57.1; 242/66

[51] Int. Cl. ..... B65h 19/20; B61h 17/08

[58] Field of Search ..... 242/56 R, 56 A, 66, 67, 242/57.1

[56] References Cited

UNITED STATES PATENTS

| | | | |
|---|---|---|---|
| 1,248,542 | 12/1917 | Pope | 242/56 R |
| 1,872,018 | 8/1932 | Street | 242/56 R |
| 3,098,619 | 7/1963 | Washburn | 242/66 |
| 3,250,484 | 5/1966 | Fair | 242/66 |
| 3,537,662 | 11/1970 | Keesling | 242/66 X |
| 3,592,403 | 7/1971 | Schmitt | 242/56 R |

*Primary Examiner*—Edward J. McCarthy
*Attorney, Agent, or Firm*—William W. Haefliger

[57] ABSTRACT

Pliable sheet handling apparatus and method concerns rapid and efficient unrolling of sheet, such as carpet, from a heavy roll; transporting, measuring and cutting a sheet length; and re-rolling the severed sheet section.

32 Claims, 14 Drawing Figures

13
10
11
12
15
20
19
21
22
14
24
48
27
25
47
26
43
44
29
63
178
177
103
102
67
65
75
85
86
98
91
90
72
285
110
117
121
127
124
13d
119
113
137
116
111
118
115
114
124a
13e
62
64
102
103
104
60

63
13a
14
14a
31
32
33
34
35
43
44
28
29
26
45
45a
55
52
51
12a
57
55a
53
58
24
12a
54
56
54a
57
56
15a
27
46
46a
13
12
15
10
30

CARPET FEEDING, MEASURING AND ROLLING APPARATUS

BACKGROUND OF THE INVENTION

This invention relates generally to the handling of pliable sheet rolls, and more particularly concerns equipment and method for unrolling sheet such as carpet from a heavy roll, transporting, measuring and cutting a sheet length, and re-rolling the severed sheet section.

In the past, the handling of heavy carpet rolls in warehouses to remove desired length carpet sections has been undesirably expensive in terms of involved labor cost. While attempts have been made to reduce such cost, to our knowledge none have provided the unusual advantages in construction, mode of operation and results as are now afforded by the present invention.

SUMMARY OF THE INVENTION

It is a major object of the invention to provide handling equipment for pliable sheet rolls characterized as substantially reducing the time, labor and cost involved in handling heavy rolls, in the manner to be described. Basically, the apparatus includes first means to rotate a pliable sheet or supply roll at a first station and in an unrolling direction to advance unrolled sheet extent generally longitudinally forwardly, whereby such extent may be severed laterally crosswise at a selected longitudinal location to free a section of the unrolled sheet from the supply roll; and other means to receive the severed section at a subsequent station located forwardly of the first station and to re-roll that section forming a final roll. As will appear, support means may be located to receive the advancing sheet unrolled extent in position for severing, such support means including a gas bearing tending to float the advancing unrolled sheet extent; further, the gas bearing may include a table containing multiple discharge ports for gas or air that tends to float the sheet extent advancing over the table. Also, a cutter may be supported to operate in a gas releasing slot in the table, and to be transported lengthwise of the slot, i.e. crosswise of the sheet, for severing same.

A further object concerns the provision of the first means in the form of a carriage having endless drive elements such as belts to support and controllably rotate the supply roll, there being structure to support the carriage for lateral shifting adjustment as well as pivoting, for accurately directing the sheet in "squared" relation with the cutting slot in the float table.

A still further object concerns the provision of the other means in the form of support roller mechanism together with auxiliary means movable between rearwardly collapsed position (in which re-rolling of the severed section is initiated at the second station) and a series of forwardly extended positions in which such re-rolling is guided toward completion. Such auxiliary means may include arm structure progressively swingable forwardly re-rolling progresses, whereby final roll weight is transferred to a roller on the arm structure which blocks dumping of the final roll, and means to swing the arm structure even further to remove support of the final roll and allow dumping of the final roll.

These and other objects and advantages of the invention, as well as the details of an illustrative embodiment, will be more fully understood from the following description and drawings, in which:

DRAWING DESCRIPTION

DETAILED DESCRIPTION

Figure 1:
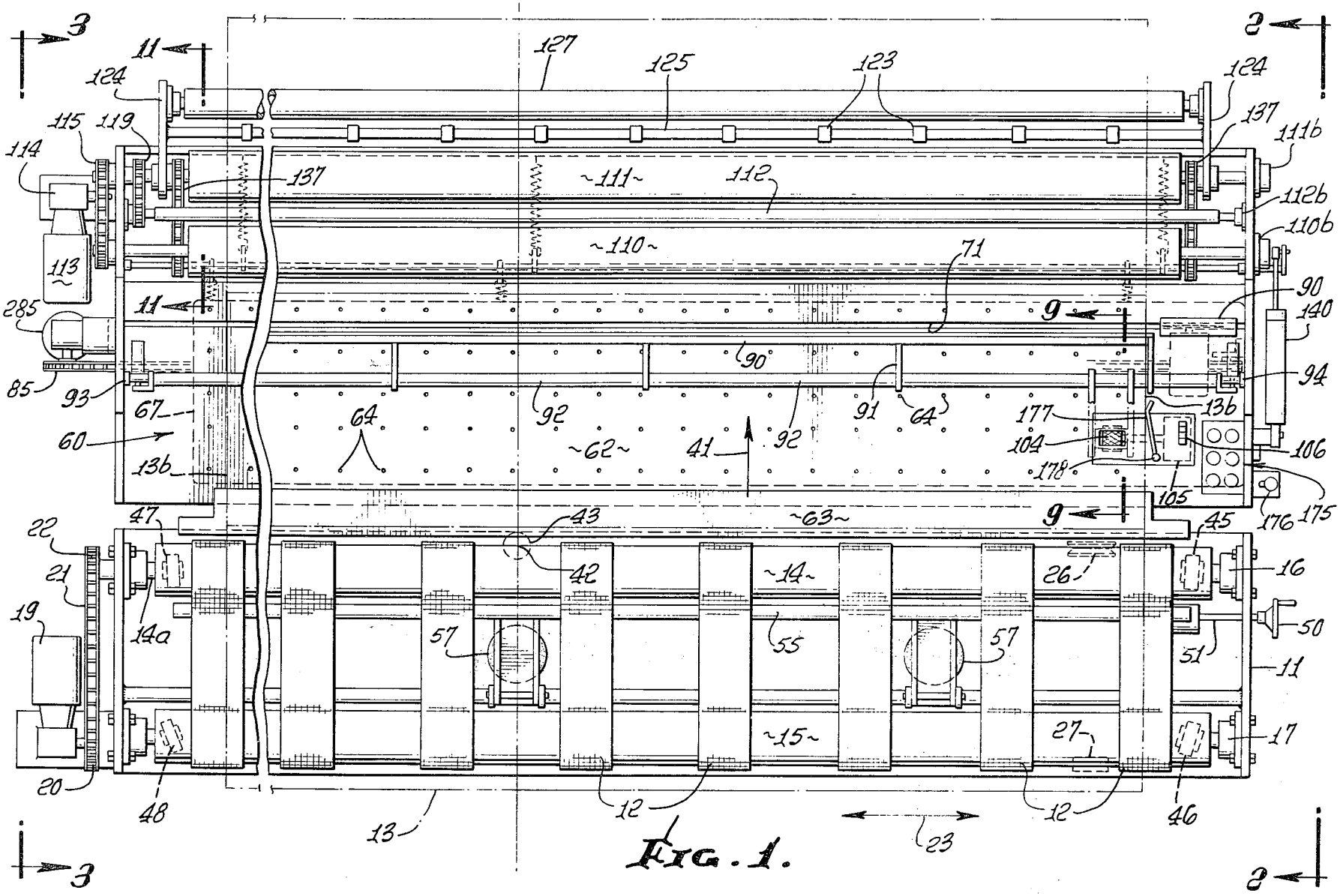
FIG. 1 is a plan view of apparatus embodying the invention.

Generally speaking, the sheet or carpet (hereinafter called carpet) handling apparatus comprises first means to rotate a carpet supply roll at a first station and in an unrolling direction to advance unrolled carpet extent in a generally longitudinally forward direction indicated by arrow 41 so that the carpet may be severed. In the example seen in FIGS. 1–4 and 8, such first means may with unusual advantage include a carriage 10 having a frame 11 and endless drive elements, as for example belts 12, to support and rotate the starting or supply carpet roll 13 in the direction indicated by arrow 40. The belts are laterally spaced apart and entrained about laterally elongated, longitudinally spaced rollers 14 and 15 having axles **14*a* and 15*a* carried by journals 16 and 17 on the frame 11. As a result, the roll 13 is cradled or slung by the downwardly convex belt upper extent 12*a* between the rollers, as seen in FIG. 2, for orienting the roll 13 during forward feeding of the unrolled extent 13*a* over and forwardly beyond the roller 14. The latter may be driven as by a reversible drive that includes a motor 19, drive sprocket 20, chain 21, and driven sprocket 22 on axle 14*a*, as best seen in FIGS. 1 and 2**, for driving the belts which in turn rotate the carpet roll in either direction, as desired.

Figure 2:
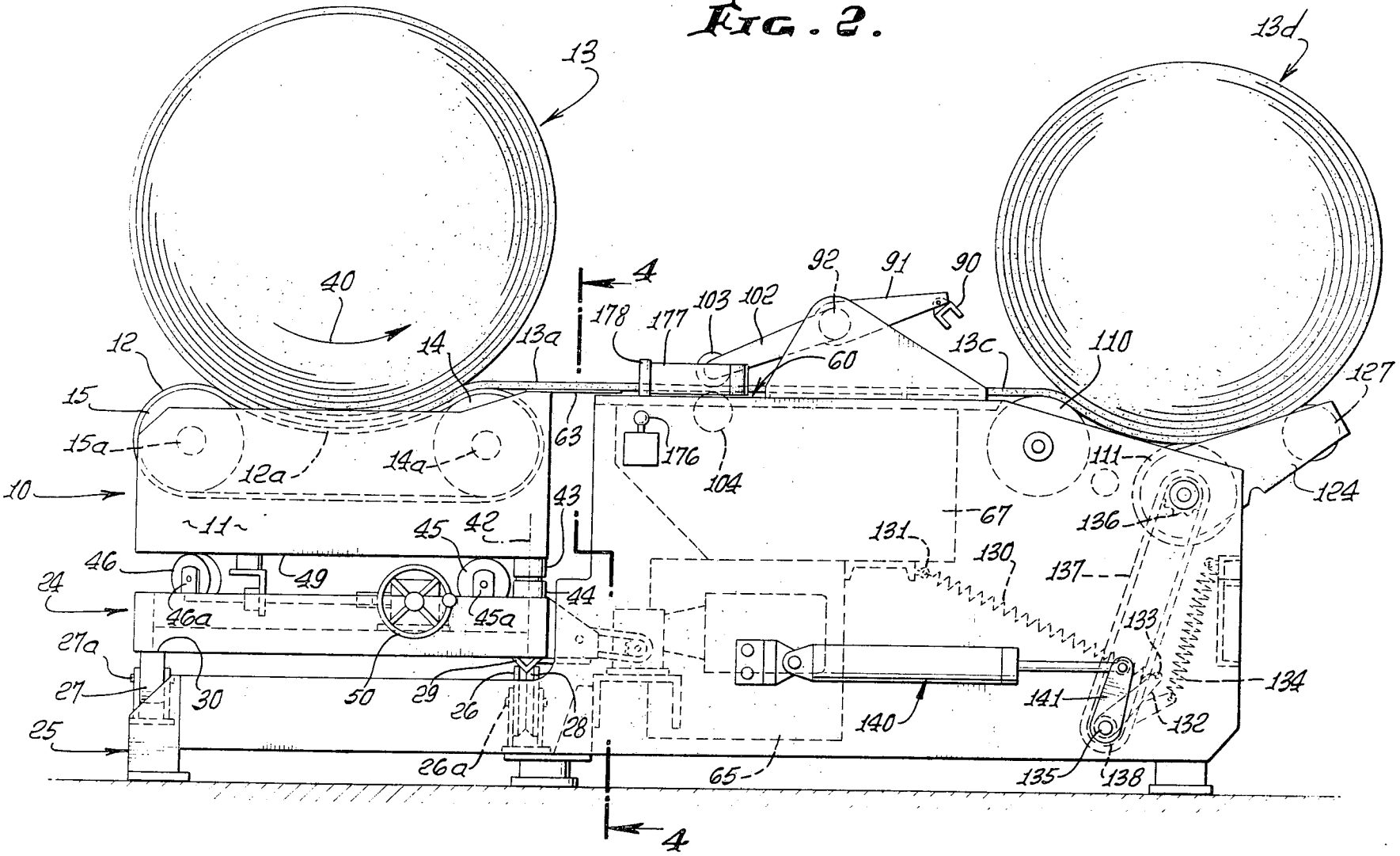
FIG. 2 is a right side elevation taken on lines 2—2 of FIG. 1.
Figure 4:
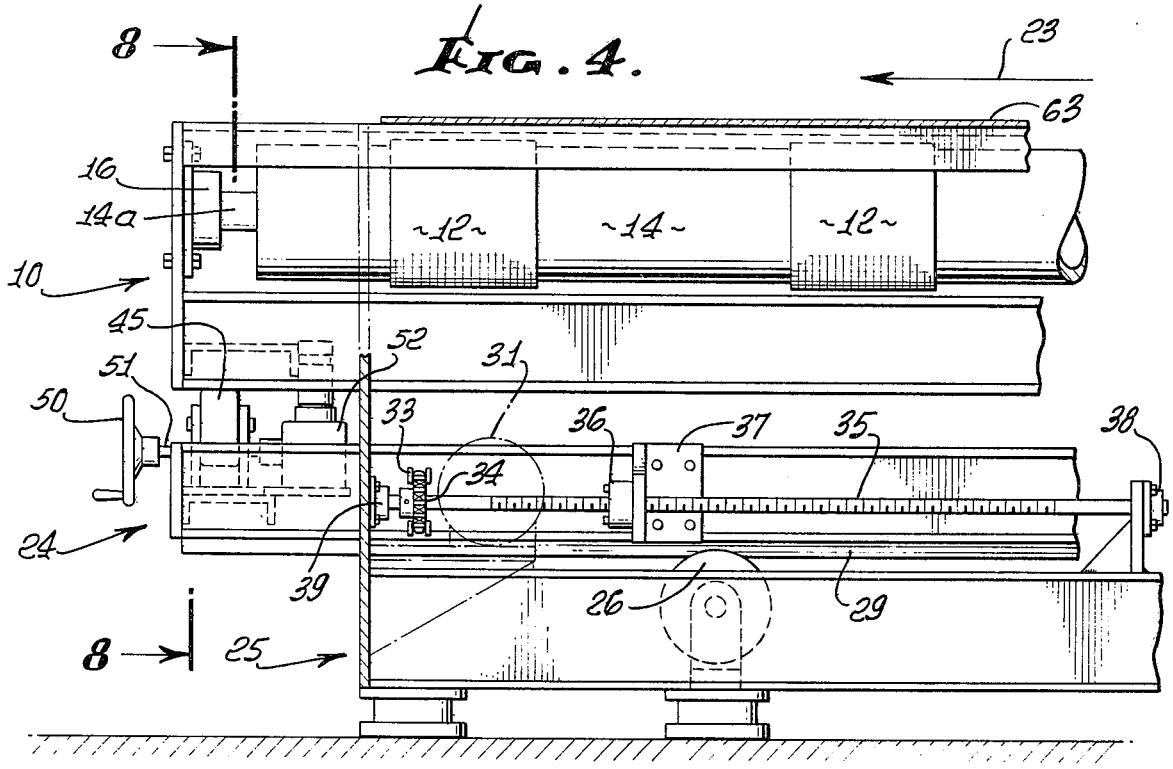
FIG. 4 is a vertical section on lines 4—4 of FIG. 2.
Figure 8:
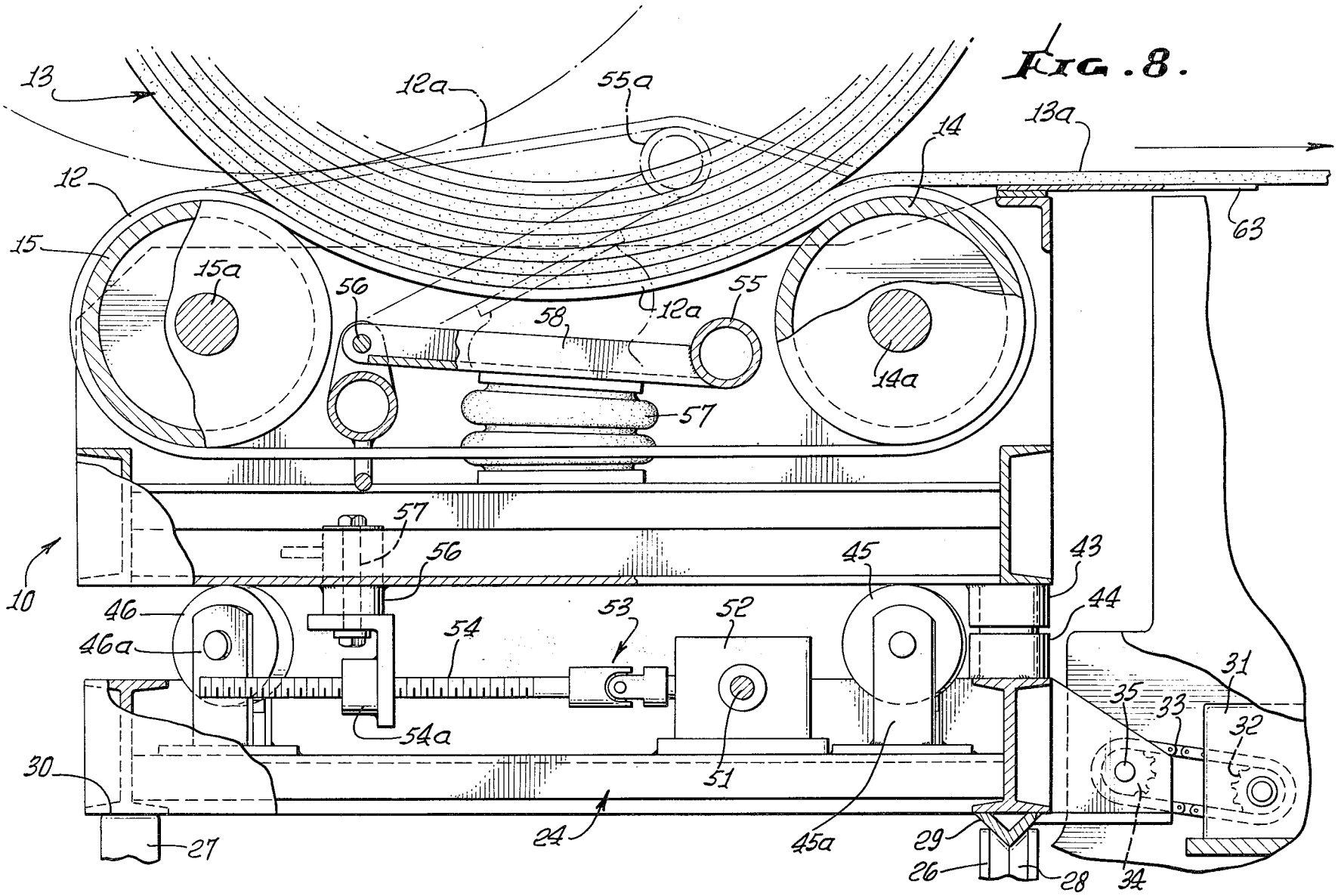
FIG. 8 is an enlarged front elevation taken on lines 8—8 of FIG. 4.

Structure may be provided to support the carriage for adjustable lateral displacement in directions indicated by arrows 23 in FIG. 1. Such structure may include an undercarriage 24 supporting carriage 10, and movable laterally relative to the main frame 25 of the overall apparatus. In this regard, forward and rearward fixed position wheels 26 and 27 may be journaled by the main frame as at **26*a* and 27*a* to support the under-carriage; thus, forward wheels may define V-cross section annular grooves 28 guidingly receiving the V-shaped lateral channel 29 attached to the underside of carriage 24, and the peripheries of the rear wheels 27 may directly engage the flat underside of the carriage 24**, as at 30. Referring to FIGS. 4 and 8, a drive to shift the carriage laterally may include drive 31, driven sprocket 32, chain 33, driven sprocket 34 on feed screw shaft 35, and an internally threaded follower at 36 attached at 37 to under carriage 24; thus, the direction of rotation of shaft 35 governs the endwise direction of carriage shifting. The ends of shaft 35 are journaled to the main frame at 38 and 39.

Figure 5:
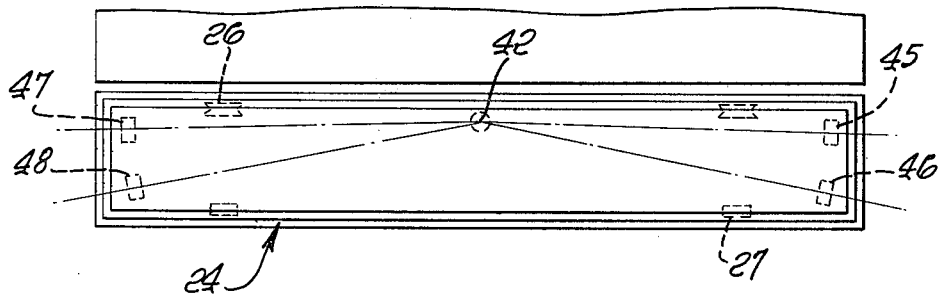
FIG. 5 is a schematic plan view of the pivot carriage seen in FIGS. 1–3.
Figure 6:
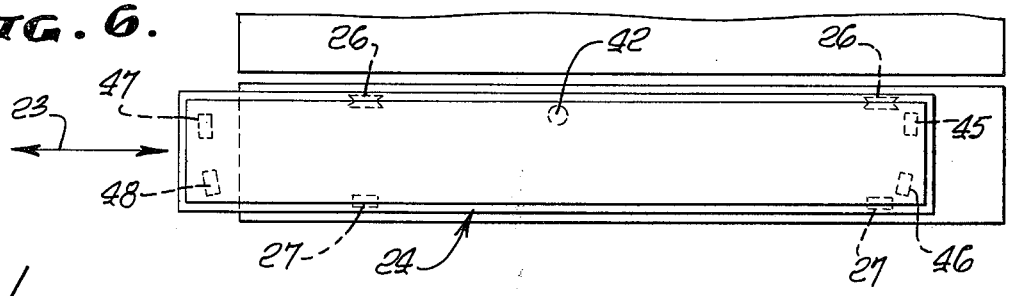
FIG. 6 is a view like FIG. 5 showing the pivot carriage in laterally shifted condition.
Figure 7:
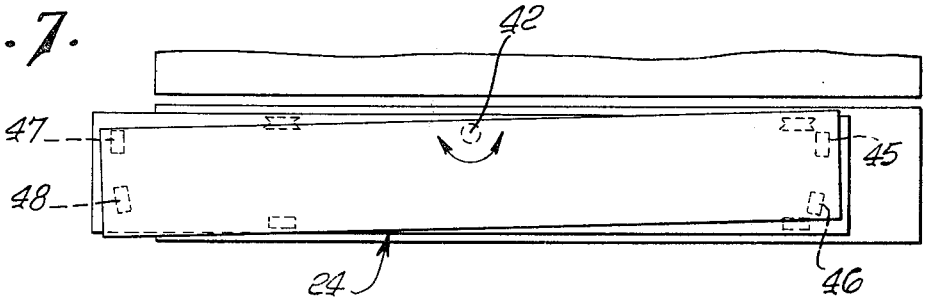
FIG. 7 is a view like FIG. 5 showing the pivot carriage in pivoted condition.

Means is also provided to support carriage 10 to pivot about an axis generally normal to the longitudinal and lateral directions 41 and 23. In the example, such a pivot axis appears at 42, and extends vertically, reference being had to FIGS. 1, 2, and 5–7. Thus the two carriages may be pivotally intercoupled as via members 43 and 44. Pivot wheels 45–48 are journaled to the undercarriage as at 45*a* and 46*a* in FIG. 2, so that the underside 49 of carriage 10 may rest on such wheels, rotation of the latter accommodating pivoting of the supported carriage 10. Drive means to effect such pivotal movement may include a manually rotatable wheel 50 on a rotatable threaded shaft 51, a right angle drive gear box 52 on under carriage 24, a universal joint 53 which is rotated as the wheel 50 is turned, a screw shaft 54 rotated by joint 53, a follower nut 54*a* on shaft 54, and a connection 56 to carriage 10 which is pivotally coupled at 57 to follower nut 54*a*. Since these elements are offset from axis 42, rotation of hand wheel 50 effects pivoting of carriage 10 about axis 42, thereby to accurately direct forward travel or "squaring" of the unrolled extent 13*a* of the carpet, and in relation to cutting and re-rolling structure to be described. Note that the axes of wheels 45–48 are directed to intersect axis 42, as is clear from FIG. 5.

As a result of such lateral shifting and pivoting of the carriage 10, the roll 13 may be positioned so that the opposite side edges 13*b* of the carpet unrolled extent 13*a* seen in FIG. 1 are correctly oriented for accurate measuring, cutting and re-rolling of the carpet section subject to severing.

Pusher means may also be provided on the carriage 10 to be selectively operable to push the belt-supported supply roll 13 upwardly or generally away from the carriage, and resulting in rearward dumping of the supply roll off the carriage. As a result, the supply roll (after removal of a section of carpet therefrom) may be easily picked up by a fork lift or other equipment for transportation to storage. Such means may, for example, include laterally elongated eject bars 55 carried by levers 58 fulcrumed at 56 on the carriage 10, to be swung upwardly to roll eject positions as indicated at 55*a* in FIG. 8. Actuators to elevate the levers and pusher bars 55 may advantageously comprise air bags 57 which flex as the levers swing upward. Note that the bars 55 push the drive belt upper stretches 12*a* upwardly, so that the roll 13 is then caused to roll rearwardly down the ramps formed by such elevated stretches.

The carpet handling apparatus may, with unusual advantage, also include support means located generally forwardly of the carriage 10 and roll 13 to receive and support the advancing unrolled carpet extent 13*a*, and in position to be severed at a selected longitudinal location along the carpet length. In the example seen in FIGS. 1, 2, 3, 9 and 10, the support means may include a plate or table 60 supported by main frame structure 61 so that the table provides an upwardly presented surface 62. A transfer plate may be provided at 63 to extend rearwardly from overlapping relation with the table rear edge toward the roller 14, for supporting the unrolling carpet as it travels forwardly from belts 12 onto the table.

The support means may include a gas or air bearing operating to at least partially float the unrolled carpet extent advancing over the table, thereby to reduce sliding friction tending to develop as the carpet 13*a* slidably advances over the table. For this purpose, the table may typically contain multiple ports 64 opening at surface 62 to underlie the unrolled carpet extent, the ports distributed generally uniformly as seen for example in FIG. 1. Means to supply gas or air under pressure to the ports may include an adjustable speed blower 65 having a discharge outlet 66 to plenum chamber 67 directly underlying the table and the through ports 64. Walls of the plenum chamber appear at 68–70 in FIG. 9.

Figure 9:
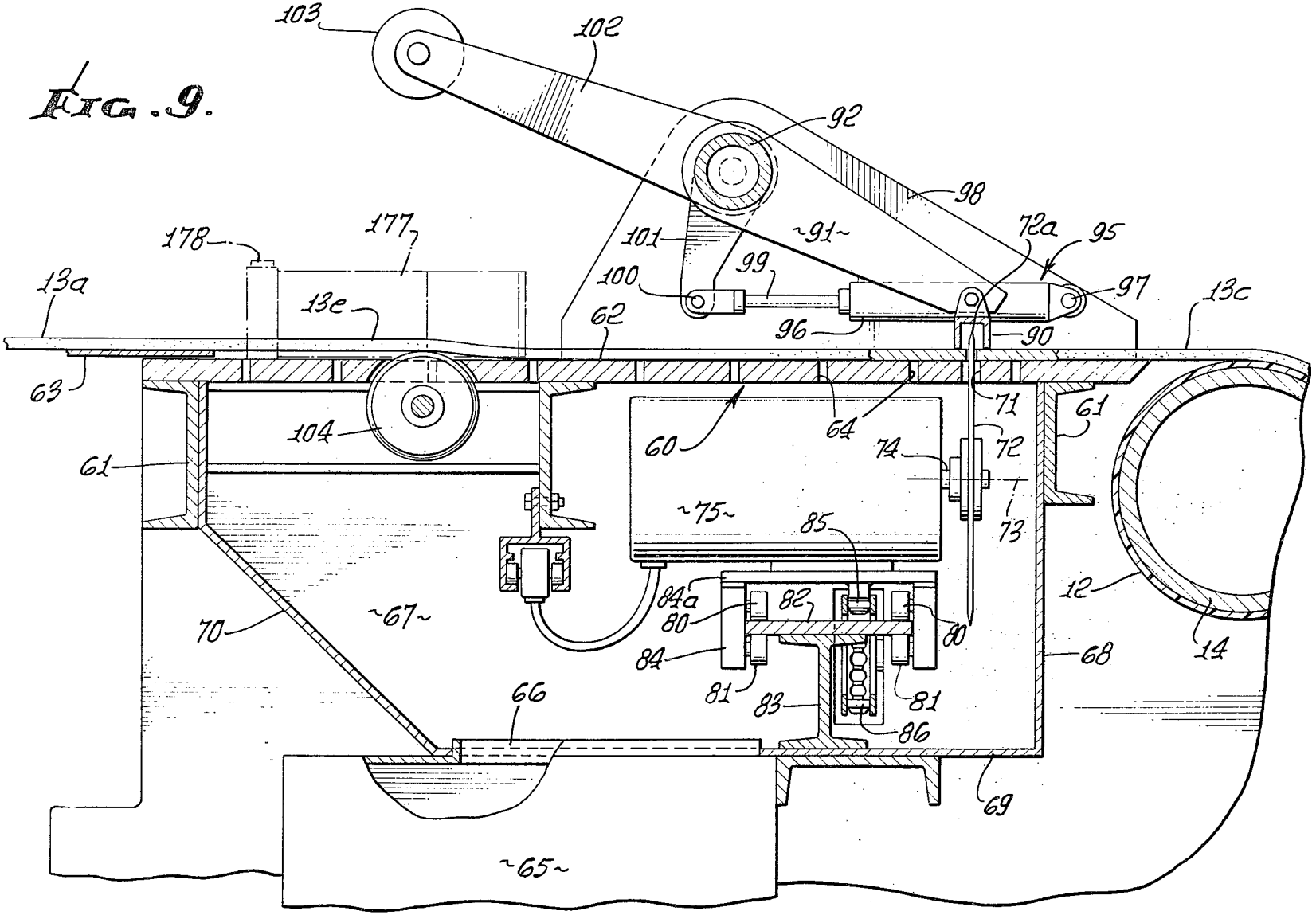
FIG. 9 is an enlarged elevation taken in section on lines 9—9 of FIG. 1.

Also provided is a cutter supported for movement laterally crosswise of the unrolled carpet 13*a* and in severing relation therewith, proximate the table. In the example, the table forms a through slot 71 extending lengthwise laterally crosswise of the table, and opening at surface 62. The illustrated cutter comprises a rotary blade 72 the uppermost cutting edge 72*a* of which projects through and above the slot as seen in FIG. 9, the blade being rotatable about forwardly extending axis 73 of shaft 74, as by a motor 75. A carrier for the motor and blade is located within the plenum chamber 67 to travel the blade lengthwise of the slot 71, for severing the carpet unrolled extent crosswise thereof, freeing a selected length section 13*c* of the carpet for re-rolling to form final roll 13*d*. In this regard, the carrier may include two pairs of upper and lower wheels 80 and 81 engageable with opposite sides of a track member 82 supported by beam 83 to extend laterally horizontally, as seen in FIG. 9. Wheels 80 and 81 are carried by travel frame structure 84 integral with the motor 75. An endless chain includes upper and lower stretches 85 and 86 extending laterally above and below member 82, the upper stretch 85 attached to the carrier plate 84*a*. Suitable reversible motor means 285 is operable to drive the chain laterally to travel the motor 75 and cutter blade 72 lengthwise of the slot 71. Note that plenum chamber air or gas can escape upwardly through the slot to float the carpet extent directly above the slot.

For safety purposes, a laterally elongated U-shaped channel member or shield 90 is displaced downwardly over the carpet directly above the slot and blade edge 72*a* during cutting, as seen in FIGS. 1, 2 and 9. The channel is carried on laterally spaced rocker arms 91 carried on a laterally extending rocker shaft 92 whose opposite ends are journaled at 93 and 94. An actuator 95 includes a cylinder 96 pivotally connected at 97 with main frame panel 98, and a plunger 99 connected at 100 with a rocker shaft crank 101, whereby operation of the actuator lifts the channel 90 to allow forward advancement of the carpet sections 13*a* and 13*c*, and lower the channel during transverse cutting of the carpet as described. Shield 90 also provides damping.

Another arm 102 connected with shaft 92 carries a pressure roller 103 which, when lowered, exerts downward pressure on the carpet extent 13*e* directly over a drive wheel 104 for a meter 105 as seen in FIGS. 1 and 2. The surface of the wheel may be knurled so as to have non-slip engagement with the underside of the advancing carpet when the pressure roller 103 is lowered to locally press the floating carpet down against the wheel. Accordingly, the counter or meter 105 is then accurately driven by wheel 104 to provide an accurate display at 106 of the measured length of carpet advanced over the wheel. If the operator lowers roller 103 when the forward end of the carpet arrives at slot 71, the meter than records the length of carpet advancing past or beyond the slot, so that the operator may stop carpet advancement when a desired length carpet section has advanced past the slot. The carpet cutter may then be operated. Note that roller 103 is lowered when shield 90 is raised, and vice versa.

The carpet handling apparatus also comprises other means to receive the severed or unsevered carpet section 13*c* at a subsequent station located generally forwardly of the first station, and to re-roll the section 13*d* for forming a final roll 13*d*. Such other means may advantageously include support roller mechanism such as first and second main support rollers 110 and 111 seen in FIGS. 1–3 and 11–13, and a third roller 112 between 110 and 111, all being parallel. All three rollers may have grip surfacing as at 110*a*, 111*a* and 112*a* in FIG. 11, the first and second rollers have substantially the same diameters, the second roller 111 is at a lower level than the first 110, and the third 112 has a substantially smaller diameter than the first two and its top surface is below top surface level of roller 111. As a result, the second and third rollers 111 and 112 initially seat the carpet section as it initially forms the re-roll 13*d*, in FIG. 11, and the first and second rollers 110 and 111 are located to seat the carpet re-roll during final build-up as seen in FIG. 12. As shown in FIG. 1, the rollers 110–112 may be end journaled at 110*b*, 111*b* and 112*b*; further, all three rollers may be driven in the same rotary direction as by means of motor 113 seen in FIG. 3, gear box 114, chain 115 driven by sprocket 116 and driving sprockets 117 and 118 on rollers 110 and 111, and chain 119 entrained on sprocket 120 on roller 111 and sprocket 121 on roller 112.

Figure 11:
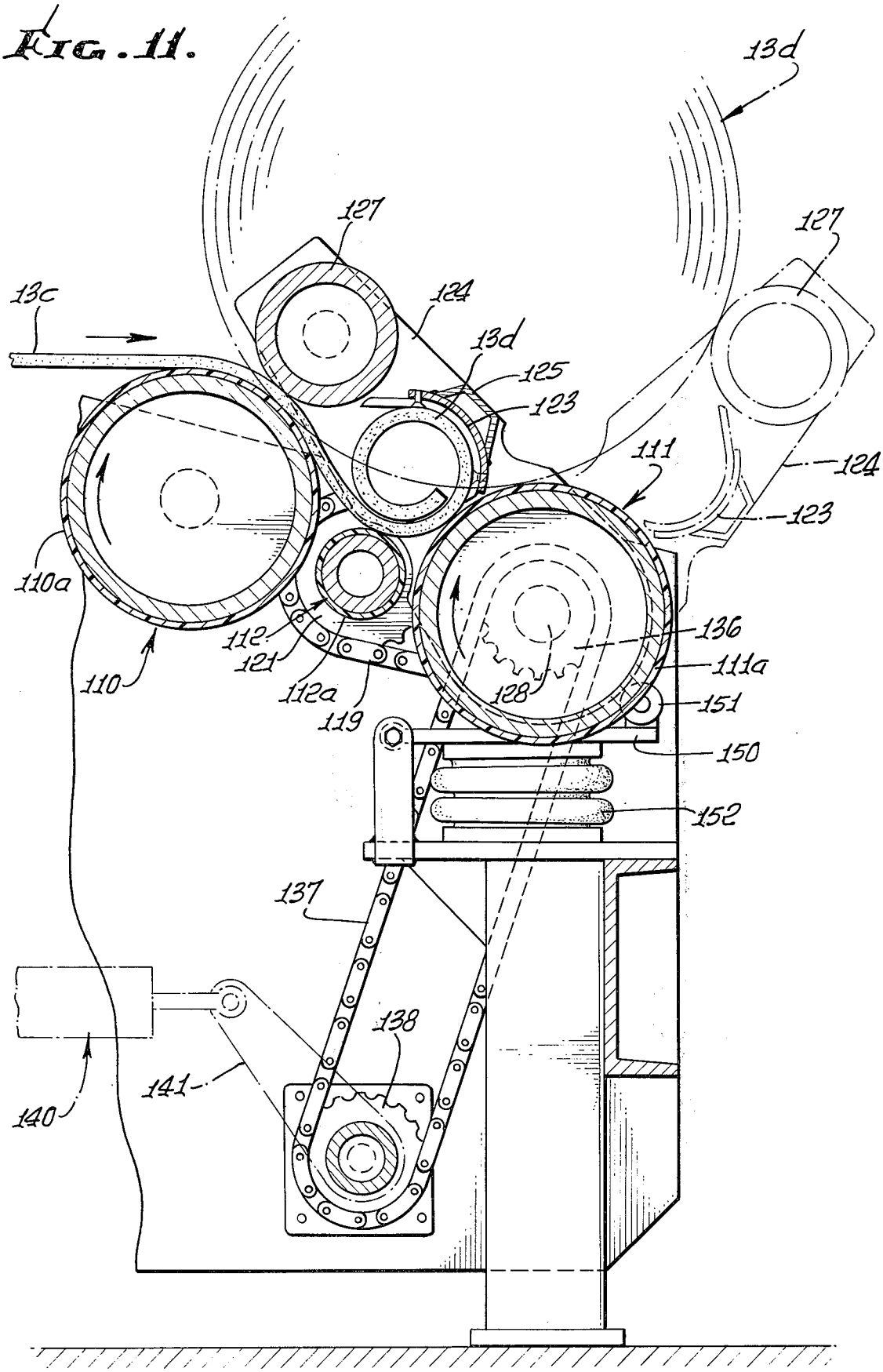
FIG. 11 is an enlarged elevation taken in section on lines 11—11 of FIG. 1.
Figure 12:
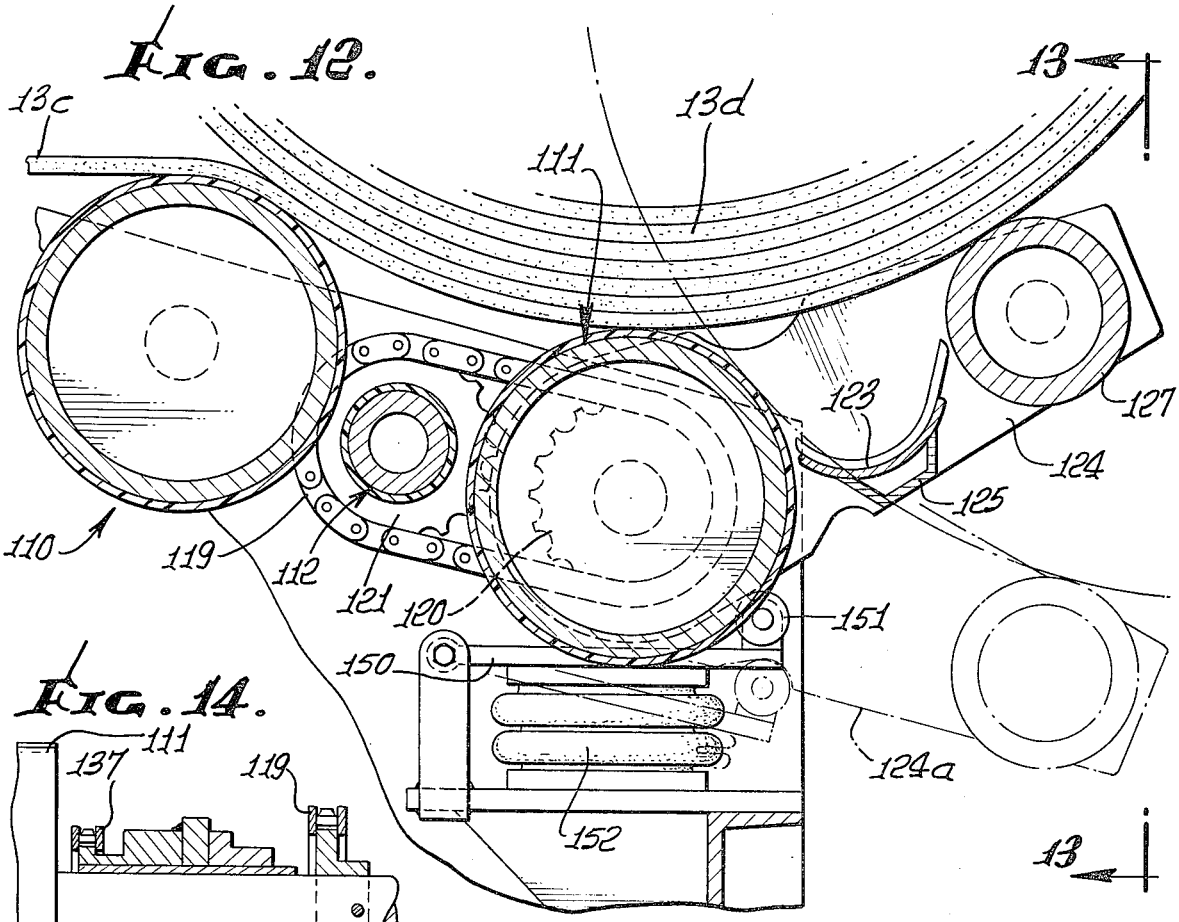
FIG. 12 is an enlarged elevation showing dump mechanism also shown in FIG. 3.
Figure 14:
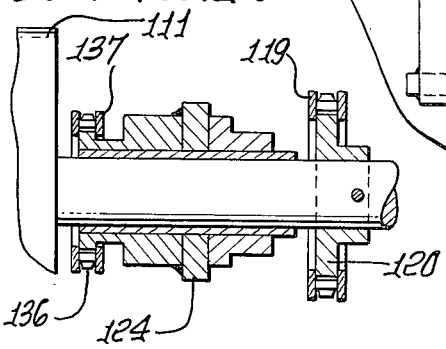
FIG. 14 is an elevation taken on lines 14—14 of FIG. 13.
Figure 13:
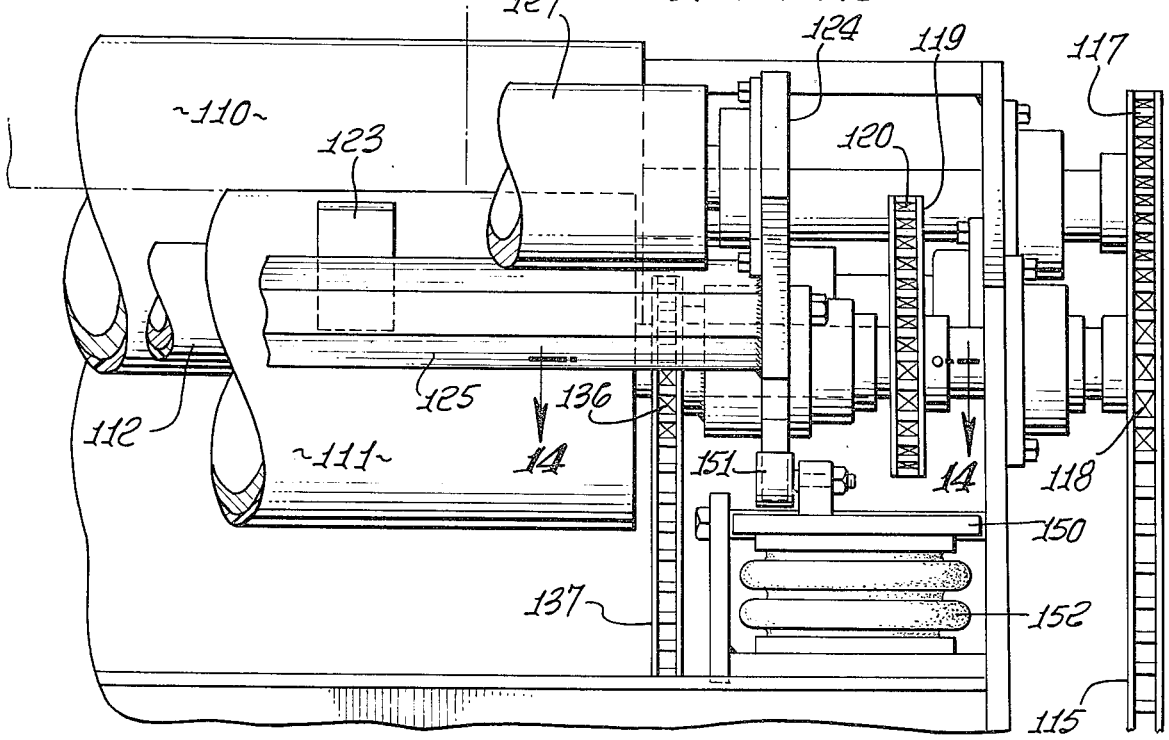
FIG. 13 is an enlarged elevation taken on lines 13—13 of FIG. 12.

Auxiliary means is provided to be movable between rearwardly collapsed position in which re-rolling of the carpet section adjacent rollers 110–112 is initiated, and series of forwardly extended positions in which such re-rolling is guided toward completion, and while the auxiliary means engages the carpet section being re-rolled, In the example, such auxiliary means includes a shield or multiple laterally spaced shields 123 in the path of the carpet advancing past or over the roller 110 and deflected upwardly by roller 111, the shield or shields being concave toward the advancing carpet and located directly above roller 111 in FIG. 11 to start re-rolling. The shield or shields are typically carried by arm structure including laterally spaced arms 124 and elongated member 125 extending therebetween. The arm structure also carries an auxiliary idler roller 127 to seat the carpet section being re-rolled during final build-up thereof, as seen in FIG. 12, the shields then being inoperative. For this purpose, the arm structure may be pivotally carried at 128 for swinging movement about the axis of roller 111 between rearwardly collapsed position as seen in FIG. 11, and forwardly extended positions as seen in FIG. 11 corresponding to progressive re-rolling of the roll 13*d*. Shields 123 may consist of molded tetrafluoroethylene.

Means is operatively connected with the arm structure to yieldably urge the latter toward rearwardly collapsed position with torque that increases as the arm structure swings toward forwardly extended positions, thereby to counterbalance the weight of the carpet re-roll. Such means may include a tension spring 130 seen in FIG. 2 as having its opposite ends respectively connected with the main frame at 131 and with a crank 132 at 133. An additional spring 134 may also be used, if desired. Crank 132 is pivoted at 135 and is rotated clockwise by arm 124 via a sprocket 136 on that arm, chain 137 and sprocket 138 integral with the crank, such crank rotation being opposed by spring 130.

Figures 3, 10:
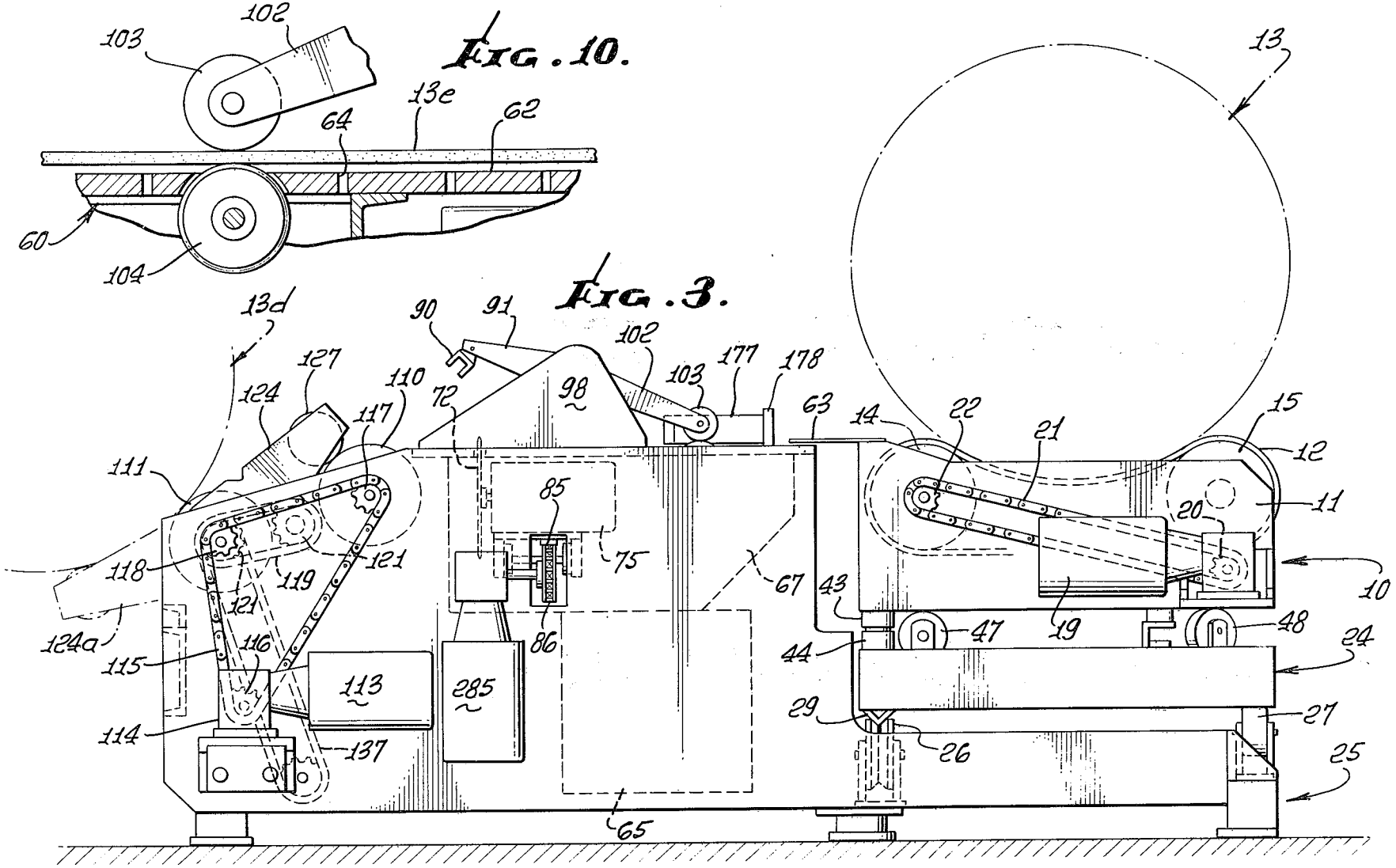
FIG. 3 is a left side elevation taken on lines 3—3 of FIG. 1.
FIG. 10 is an enlarged elevation showing a carpet unrolled length counter.

Actuator means 140 is also connected with arm 124, as via another crank 141 driving sprocket 138, chain 137 and sprocket 136, to swing the arm structure and idler roller 127 thereon between its forward carpet roll supporting position (as seen in FIGS. 2, 11 and 12) and an extreme forward position (as seen at 124*a* in FIGS. 3 and 12). In the latter position, the completed re-roll 13*d* may be forwardly dumped as by rolling off the rollers 110 and 111. In addition, an ejector bar or lever 150 and roller 151 thereon may be swung upwardly as by expansion of a pusher air bag 152, as seen in FIG. 12, to aid such dumping.

Accordingly, it is clear that counterbalancing of the re-roll apparatus enhances safety and permits back-pressure re-winding of the carpet section 13*c* to produce a compact product roll 13*d*, which is desirable for subsequent handling, wrapping and shipping.

A control panel is indicated at 175 in FIG. 1, with control buttons to control opening and crossing of pneumatic valves, the latter controlling the various pneumatic actuators as described. A toggle 176 controls a valve which in turn controls dump actuator 140.

A lever 177 pivoted at 178 is engageable by the right edge 13*b* of the carpet as seen in FIG. 1, and the operator may observe deflection of that lever in order to control endwise travel of carriage 10.

From the foregoing, it is seen that the invention enables semi-automatic handling of pliable sheets to be measured and/or re-rolled, and/or inspected, and/or cut to measured length. typical pliable sheets include carpet, linoleum, paper, cardboard, rug cushioning materials, foam rubber, urethane foam, felt padding, textiles, canvas, roofing felt, burlap, plastics, leather, cork, etc; however, the invention has especially advantageous application to carpet.

We claim:

1. In pliable sheet handling apparatus, a. first means to rotate a sheet supply roll at a first station and in an unrolling direction to advance unrolled sheet extent in a generally longitudinally forward direction, and to sever unrolled sheet extent laterally crosswise thereof at a selected longitudinal location to free a section of the unrolled sheet from the supply roll, b. other means to receive the severed section at a subsequent station located generally forwardly of the first station, and to re-roll said section forming a final roll, and c. support means located generally between said first and other means to receive and support the advancing unrolled sheet extent in position for said severing, said support means including a table having an upper surface, there being multiple ports proximate said surface to underlie said unrolled sheet extent, and means to supply gas to discharge from said ports for exerting upward pressure on said unrolled sheet extent and tending to float said sheet extent as it advanced forwardly.

2. In pliable sheet handling apparatus, a. a first means to rotate a sheet supply roll at a first station and in an unrolling direction to advance unrolled sheet extent in a generally longitudinally forward direction, whereby unrolled sheet extent may be severed laterally crosswise thereof at a selected longitudinal location to free a section of the unrolled sheet from the supply roll, said first means including a carriage having endless drive elements to support and rotate the supply roll, there being structure supporting the carriage for adjustable lateral shifting, and a drive to shift the carriage laterally, b. other means to receive the severed section at a subsequent station located generally forwardly of the first station, and to re-roll said section forming a final roll, said other means including support roller mechanism, and auxiliary means movable between rearwardly collapsed position in which re-rolling of the sheet section adjacent said support roller mechanism is initiated, and a series of forwardly extended positions in which re-rolling of the sheet section is guided toward completion, and while the auxiliary means engages the sheet section being re-rolled, said auxiliary means including a bodily movable roller having a rearward position in which the roller extends at one side of the sheet section to urge the sheet section toward the support roller mechanism, and a forward position in which the roller extends at the opposite side of the sheet section being re-rolled during final build-up thereof and in supporting relation with the re-rolled section.

3. In pliable sheet handling apparatus, a. first means to rotate a sheet supply roll at a first station and in an unrolling direction to advance unrolled sheet extent in a generally longitudinally forward direction, whereby unrolled sheet extent may be severed laterally crosswise thereof at a selected longitudinally location to free a section of the unrolled sheet from the supply roll, b. other means to receive the severed section at a subsequent station located generally forwardly of the first station, and to re-roll said section forming a final roll, and c. support means located generally between said first and other means to receive and support the advancing unrolled sheet extent in position for said severing, said support means including a table having an upper surface, there being multiple ports proximate said surface to underlie said unrolled sheet extent, and means to supply gas to discharge from said ports for exerting upward pressure on said unrolled sheet extent and tending to float said sheet extent as it advances forwardly.

4. The apparatus of claim 3 including a cutter supported for movement laterally crosswise of the unrolled sheet and in severing relation therewith, proximate the table.

5. The apparatus of claim 4 wherein said table forms a slot extending lengthwise laterally crosswise thereof and opening at said surface, the cutter comprising a rotary blade, and a carrier for transporting the blade lengthwise of the slot while rotating therein.

6. The apparatus of claim 4 including a length meter having a rotary drive wheel projecting proximate the table surface to be frictionally driven by the unrolled sheet extent being fed over the table.

7. In pliable sheet handling apparatus, a. first means to rotate a sheet supply roll at a first station and in an unrolling direction to advance unrolled sheet extent in a generally longitudinally forward direction, whereby unrolled sheet extent may be severed laterally crosswise thereof at a selected longitudinal location to free a section of the unrolled sheet from the supply roll, and b. other means to receive the severed section at a subsequent station located generally forwardly of the first station, and to re-roll said section forming a final roll, said other means including support roller mechanism, and auxiliary means movable between rearwardly collapsed position in which re-rolling of the sheet section adjacent said support roller mechanism is initiated, and a series of forwardly extended positions in which re-rolling of the sheet section is guided toward completion, and while the auxiliary means engages the sheet section being re-rolled, said auxiliary means including a bodily movable roller having a rearward position in which the roller extends at one side of the sheet section to urge the sheet section toward the support roller mechanism, and a forward position in which the roller extends at the opposite side of the sheet section being re-rolled during final build-up thereof and in supporting relation with the re-rolled section.

8. The apparatus of claim 7 wherein said first means includes a carriage having endless drive elements to support and rotate the supply roll.

9. The apparatus of claim 7 including arm structure supporting said auxiliary means for swinging movement between said positions, and in response to build-up of the final roll.

10. The apparatus of claim 9 wherein the arm structure also has an extreme forward position in which said roller unblocks forward dumping of the final sheet roll off the support roller mechanism.

11. The apparatus of claim 9 wherein said auxiliary means includes a shield in the path of the advancing sheet section to start said re-rolling thereof, when said arm is in rearwardly collapsed position, and an idler roller to seat the sheet section being re-rolled during final build-up thereof when the arm is in said forwardly extended positions.

12. The apparatus of claim 9 wherein said support roller mechanism includes first and second main support rollers, the second spaced forwardly of the first, and a third roller between the first and second support rollers, the second and third rollers located to initially seat the sheet section being re-rolled, and the first and second rollers located to seat the sheet section being re-rolled during final build-up thereof.

13. The apparatus of claim 12 wherein the second main roller is lower than the first main roller, said arm structure also having an extreme forward position in which said auxiliary means unblocks forward dumping of the final sheet roll off the first and second main rollers.

14. The apparatus of claim 13 including drive means to rotate the first, second and third rollers in sheet section re-rolling directions.

15. The apparatus of claim 13 including actuator means operatively connected with said arm structure to effect swinging thereof between said forward and extreme forward positions.

16. The apparatus of claim 9 including means operatively connected with said arm structure to yieldably urge the arm structure toward said collapsed position with torque that increases as the arm structure swings toward said forwardly extended positions, thereby to counterbalance the weight of the final sheet roll exerted on an idler roller defined by said auxiliary means.

17. In pliable sheet handling apparatus, a. first means to rotate a sheet supply roll at a first station and in an unrolling direction to advance unrolled sheet extent in a generally longitudinally forward direction, whereby unrolled sheet extent may be severed laterally crosswise thereof at a selected longitudinal location to free a section of the unrolled sheet from the supply roll, said first means including a carriage having endless drive elements to support and rotate the supply roll, b. other means to receive the severed section at a subsequent station located generally forwardly of the first station, and to re-roll said section forming a final roll, c. means supporting the carriage to pivot about an axis generally normal to said longitudinal and lateral directions, whereby forward feed of the sheet unrolled extent may be accurately directed toward said other means, and drive means to effect controlled pivoting of the carriage, and d. support means located generally between said first and other means to receive and support the advancing unrolled sheet extent in position for said severing, said support means including a table having an upper surface, there being multiple ports proximate said surface to underlie said unrolled sheet extent, and means to supply gas to discharge from said ports for exerting upward pressure on said unrolled sheet extent and tending to float said sheet extent as it advances forwardly.

18. The apparatus of claim 17 including support means located generally between said first and other means to receive and support the advancing unrolled sheet extent in position for said severing.

19. In pliable sheet handling apparatus, a. first means to rotate a sheet supply roll at a first station and in an unrolling direction to advance unrolled sheet extent in a generally longitudinally forward direction, whereby unrolled sheet extent may be severed laterally crosswise thereof at a selected longitudinal location to free a section of the unrolled sheet from the supply roll, said first means including a carriage having endless drive elements to support and rotate the supply roll, comprising drive belts, and including pusher means on the carriage and selectively operable to push the supply roll generally away from said carriage, and b. other means to receive the severed section at a subsequent station located generally forwardly of the first station, and to re-roll said section forming a final roll, said other means including support roller mechanism, and auxiliary means movable between rearwardly collapsed position in which re-rolling of the sheet section adjacent said support roller mechanism is initiated, and a series of forwardly extended positions in which re-rolling of the sheet section is guided toward completion, and while the auxiliary means engages the sheet section being re-rolled, said auxiliary means including a bodily movable roller having a rearward position in which the roller extends at one side of the sheet section to urge the sheet section toward the support roller mechanism, and a forward position in which the roller extends at the opposite side of the sheet section being re-rolled during final build-up thereof and in supporting relation with the re-rolled section.

20. In sheet handling apparatus, a. first means to rotate a sheet supply roll at a first station and in an unrolling direction to advance unrolled sheet extent in a generally longitudinally forward direction, and to sever unrolled sheet extent laterally crosswise thereof at a selected longitudinal location to free a section of the unrolled sheet from the supply roll, and b. support means located forwardly of said first means to receive and support said unrolled sheet extent in position for said severing, said support means defining a gas bearing tending to float said advancing unrolled sheet extent, said support means including a table having an upper surface containing multiple ports opening at said surface to underlie unrolled sheet extent, and means to supply gas to escape upwardly from said ports for exerting upward pressure on said unrolled sheet extent.

21. The apparatus of claim 20 including a cutter supported for movement laterally crosswise of the unrolled sheet and in severing relation therewith, proximate the table.

22. The apparatus of claim 21 wherein said table forms a slot extending lengthwise laterally crosswise thereof and opening at said surface, the cutter comprising a rotary blade, and a carrier for transporting the blade lengthwise of the slot while rotating therein, said carrier located within a plenum chamber from which gas is supplied to said ports and also to said slot.

23. The apparatus of claim 22 including a safety shield carried by actuator means to have a down position in which the shield clamps the sheet proximate the blade during said transport thereof, and a raised position spaced above the sheet.

24. The method of handling a sheet supply roll to obtain a selected length sheet section, that includes a. supporting and controllably rotating the supply roll to advance unrolled sheet extent in a forward and generally horizontal direction away from the roll, b. discharging gas at the underside of said advancing sheet extent for floatably supporting the advancing sheet extent, c. stopping advancement of said sheet extent when a selected length thereof has been advanced, and then severing said sheet extent crosswise thereof to produce a desired length sheet section free of the supply roll, d. further advancing said sheet section by force transmitted to the forward portion of said section and progressively re-rolling said section to produce a final roll.

25. The method of claim 26 including controllably supporting the final roll against dropping during said re-rolling, and then removing support of the final roll to allow forward dropping thereof.

26. The method of claim 24 including the step of discharging gas toward the sheet at the locus of said severing, during said severing.

27. The method of claim 24 wherein said sheet comprises a carpet.

28. Apparatus to receive a carpet section advanced in a generally longitudinally forward direction and to roll said section, comprising a. support roller mechanism, and b. means movable between rearwardly collapsed position in which rolling of the carpet section adjacent the support roller mechanism is initiated, and a series of forwardly extended positions in which rolling of the carpet section is guided toward completion, c. said means including a carpet guide roller and arm structure supporting said guide roller for bodily swinging movement in response to build-up of the roll, said guide roller having a rearward position in which the guide roller extends at the upper side of the carpet section to urge the carpet section toward the support roller mechanism, and forward positions in which the guide roller extends at the underside of the roll during build-up thereof and in supporting relation therewith.

29. The apparatus of claim 27 wherein said means includes a shield carried by said arm structure to extend in the path of the advancing carpet section to start said rolling thereof when the guide roller is in said rearward position, the shield being displaced by the arm structure out of said path of the advancing carpet section when the guide roller is in said forward positions.

30. The apparatus of claim 29 wherein the shield has a carpet engaging concave surface consisting of tetrafluoroethylene.

31. The apparatus of claim 27 wherein the arm structure has an extreme forward position in which the guide roller is relatively lowered to unblock forward dumping of the roll of the support roller mechanism.

32. The apparatus of claim 31 including actuator means operatively connected with the arm structure to effect swinging thereof to carry the guide roller between said positions.

* * * * *